US006250868B1

(12) United States Patent
Schmücker

(10) Patent No.: US 6,250,868 B1
(45) Date of Patent: Jun. 26, 2001

(54) BOOK PRODUCTION LINE

(75) Inventor: Christoph Schmücker, Rahden (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 09/470,617

(22) Filed: Dec. 22, 1999

(30) Foreign Application Priority Data

Dec. 22, 1998 (DE) ..... 198 59 333

(51) Int. Cl.[7] ..... B42C 5/00

(52) U.S. Cl. ..... 412/25; 412/9; 412/13; 412/902

(58) Field of Search ..... 412/9, 11, 13, 412/14, 22, 23, 24, 25, 37, 902

(56) References Cited

U.S. PATENT DOCUMENTS 3,413,669 * 12/1968 Thoirp ..... 412/9
5,114,292 * 5/1992 Geiser ..... 412/11
5,114,293 * 5/1992 Rathert ..... 412/30
5,658,111 * 8/1997 Rathert ..... 412/30
5,788,446 * 8/1998 Stolz ..... 412/9
5,868,539 * 2/1999 Rathert ..... 412/5

FOREIGN PATENT DOCUMENTS

OS 20 16 425 10/1971 (DE) .
28 10 518 A1 10/1978 (DE) .
43 34 255 A1 4/1995 (DE) .

* cited by examiner

*Primary Examiner*—Willmon Fridie, Jr.
(74) *Attorney, Agent, or Firm*—Alix, Yale & Ristas, LLP

(57) ABSTRACT

A book production line which has a plurality of processing stations and a transportation device for receiving the book blocks from an intake and conveying the book blocks to the processing stations is presented. The book production line includes individual modules with processing stations including functions such as straightening and pre-shaping, rounding and pressing, gluing and fumigating, gluing, backing and heading and suspending of book blocks. Optionally, a processing station may be provided for pressing and shaping the books and the individual modules can be separately operated via independent operating panels.

28 Claims, 3 Drawing Sheets

BOOK PRODUCTION LINE

BACKGROUND OF THE INVENTION

1. Field of the Invention

The invention relates to a book production line and, more particularly to a book production line having a transportation device receiving book blocks from an intake and conveying the book blocks to a plurality of processing stations.

2. Description of Related Art

In known book production lines of the stated type, coupled drives with a central motor and a main shaft as well as cams and linkages are used for transmitting movements. As a result of the mechanically connected drives, the movements of tools, material transportation and handling devices occur in a positively actuated fashion.

The mechanical coupling of the movements impedes a preliminary testing of individual processing stations during the setup and initial operation of the book production line, since the mechanical basic adjustment and testing is only possible following synchronization via the main shaft.

In order to adapt the book production line to different book formats or layouts, the stations can only be operated independently of one another following decoupling from the main shaft and after switching off the individual drives. Since the sequence of the processing and transportation functions is necessarily fixed, a flexible setting is only possible under certain conditions.

In addition, a plurality of mechanical components, requiring time-consuming assembly and adjustment, is necessary for the transmission and diversion of the drive output.

SUMMARY OF THE INVENTION

It is an object of the present invention to provide a book production line for processing variously sized and shaped books.

It is another object to provide a book production line which allows for a high degree of flexibility in respect of the sequence of the processing functions.

It is still another object to provide a book production line which rules out power-dependent influences upon the processing result.

It is a further object to provide a book production line which requires short inauguration times and is simple to operate.

The above and other objects are attained in one embodiment of the present invention includes a book production line which has a plurality of processing stations and a transportation device for receiving the book blocks from an intake and conveying the book blocks to the processing stations. The book production line comprises individual modules with processing stations including functions such as straightening and pre-shaping, rounding and pressing, gluing and fumigating, gluing, backing and heading and suspending of book blocks. Optionally, a processing station may be provided for pressing and shaping the books and the individual modules can be separately operated via independent operating panels.

Using the foregoing drive-control operation concept according to an embodiment of the invention advantageously provides high flexibility, short setup times, simple operation and modular construction with units which can be pre-tested resulting in short inauguration times. Individual modules can be combined by direct coupling to form a book production line which can be relatively easily dismantled.

The processing functions run as event-controlled step chains, i.e. the sequence of functions is predetermined by decentralized control of the modules. The decentralized control of the modules is attained through separate operation of the individual stations by providing a separate operating panel for each module. Only the functions of the respective module and a number of related functions can be connected to the operating panels. As a result of the flexible programming of function keys provided on the operating panels, the operating panels can be adapted to include all necessary functions. Direct access to the most important processing functions, aggregates and adjustment axes is provided via the function keys.

As a result of the separate individual drives in the respective modules, the inauguration of the book production line can be simplified and preliminary testing of individual modules during assembly is possible.

Since the steps in the individual modules can be triggered independently of one another, the conversion to another book format can be effected simultaneously by a plurality of operators. This contributes towards a reduction in setup time, since following modules can be prepared ahead of time. For the final fine adjustment, book blocks or book covers are then required from the previous processing stations. In addition, the setup can be facilitated by combining a plurality of individual steps to form processing sequences with defined start and stop points, by repeating a step or by omitting steps.

Depending on the layout or the required processing of the book, the function sequence can be predetermined in a flexible manner. In the case of simple books, the rounding and pressing, for example, can be dispensed with, while difficult products can be pressed numerous times and the gluing can be switched on and off. If a processing station is to be switched off or no book block or book cover is to be processed, e.g., during idling strokes, then no movement is triggered. In the event of a disturbance, the event-controlled step chain is interrupted during the disturbed step, so that a simple diagnosis and removal of the disturbance is possible. The modules which are not disturbed finish their processing, so that waste is reduced and subsequent stops can be avoided.

Since the functions of rounding, pressing or gluing always takes place at the same velocities even in the case of format changes, velocity-dependent influences upon the working result are avoided.

BRIEF DESCRIPTION OF THE DRAWINGS

An embodiment of the present invention is illustrated in the accompanying drawings, in which.

DETAILED DESCRIPTION OF THE PREFERRED EMBODIMENTS

The following applications have been filed contemporaneously herewith and each of which are incorporated herein by reference. U.S. patent application entitled "A Device For Backing Book Blocks", U.S. Ser. No. 09/467,572; U.S. patent application entitled "Device For The Back Rounding Of Book Blocks", U.S. Ser. No. 09/468,149 patent application entitled "A Device For Rounding And Backing Book Blocks", U.S. Ser. No. 09/,470,484.

Figure 1:
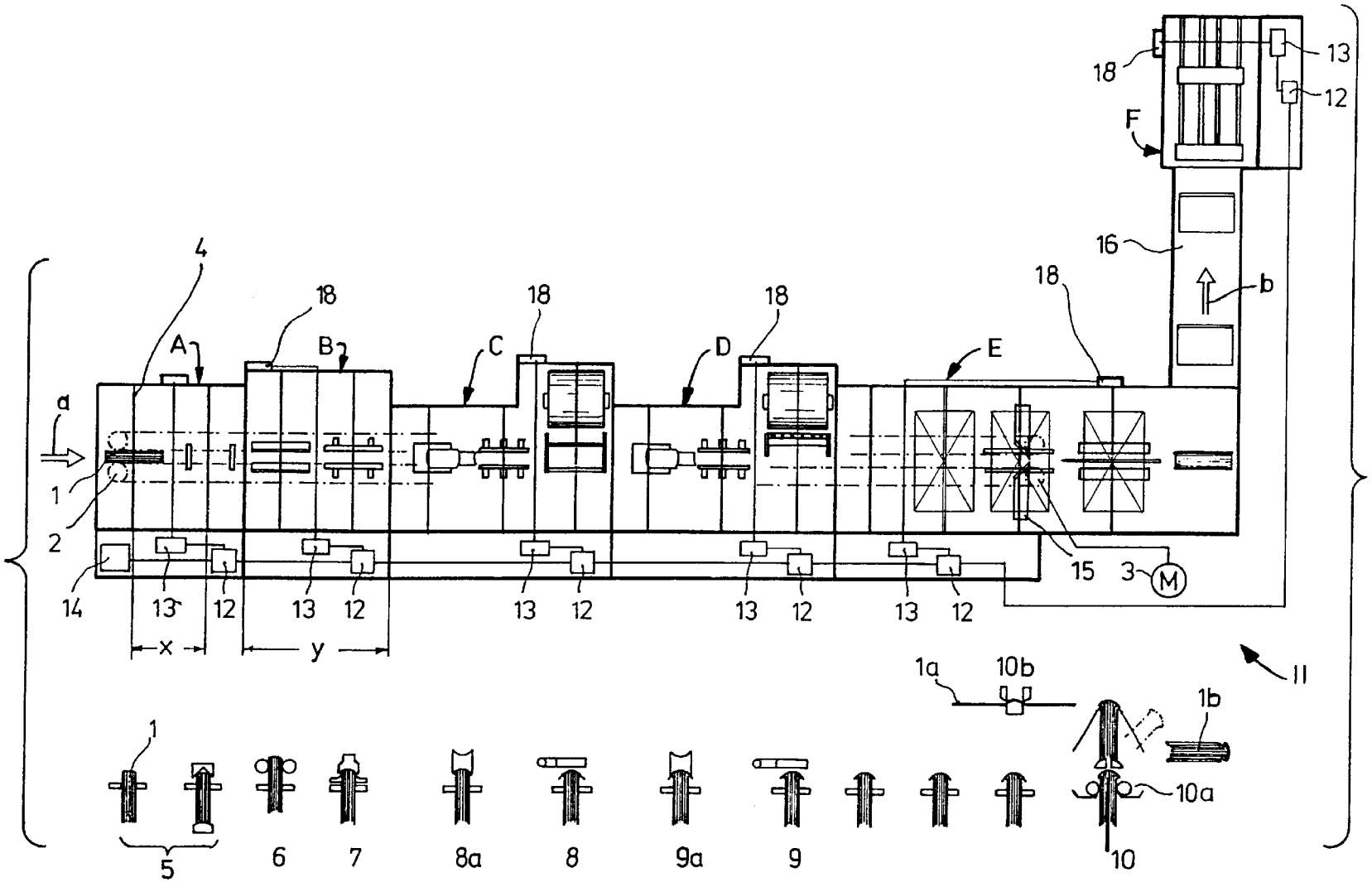
FIG. 1 is a schematic plan view of a book production line in accordance with an embodiment of the present invention.

A book production line in accordance with an embodiment of the present invention is illustrated in a schematical fashion generally at 11 in FIG. 1. The book production line includes an intake and an outlet represented by arrows a and b respectively, a processing station 5 with the functions of straightening and pre-shaping, processing stations 6 and 7 with the functions of rounding and pressing and processing stations 8*a* and 8 with the functions of backing and fumigating. The book production line also includes processing stations 9*a* and 9 with the functions of backing and heading and processing stations 10, 10*a* and 10*b* with the function of suspension of the book block with side gluing and rounding of book covers. The processing stations 5 to 10 are arranged in the individual modules A to E and are interchangeably referred to herein. Each of the processing stations 5 to 10 can be combined in various layout variants in the manner of an assembly system by direct coupling to form a book production line.

The processing stations of straightening and pre-shaping 5 to backing and heading 9 are arranged at a defined timed interval x relative to one another. Book blocks 1 are held in clamped fashion via a continuous transportation device 2 driven by a drive motor 3 in an intermittent or stepped fashion. The transportation device 2 comprises continuous support chains and chain guidance segments 2*a* of the individual modules. The book blocks 1 are conveyed from the intake a to the individual processing stations A to D into a position aligned with the center 4 of the book block as far as the processing station E for suspension. It will be understood that the center 4 is illustrated in FIG. 1 as being indicative of the center of a book block 1 which may be located at the center of a height of the book block, i.e., between a head (a non-folded edge) and a foot (another non-folded edge) of the book block. At the processing station E the book blocks are taken up by a connecting conveyor 15 and suspended after being supplied with a book cover 1*a* having a rounded back. The books 1*b* travel through outlet b along conveyor 16 to a compression molding station F which is a further individual module.

The individual modules A to E have a grid size y which lies in a timed interval x and which corresponds to a multiple of the chain pitch of the transportation device 2.

According to an embodiment of the invention, the functions in the processing stations 5 to 10 of the individual modules A to E and in the individual module F for pressing and shaping the books 1*a* are carried out via independent motor, hydraulic and pneumatic drives.

Figure 2:
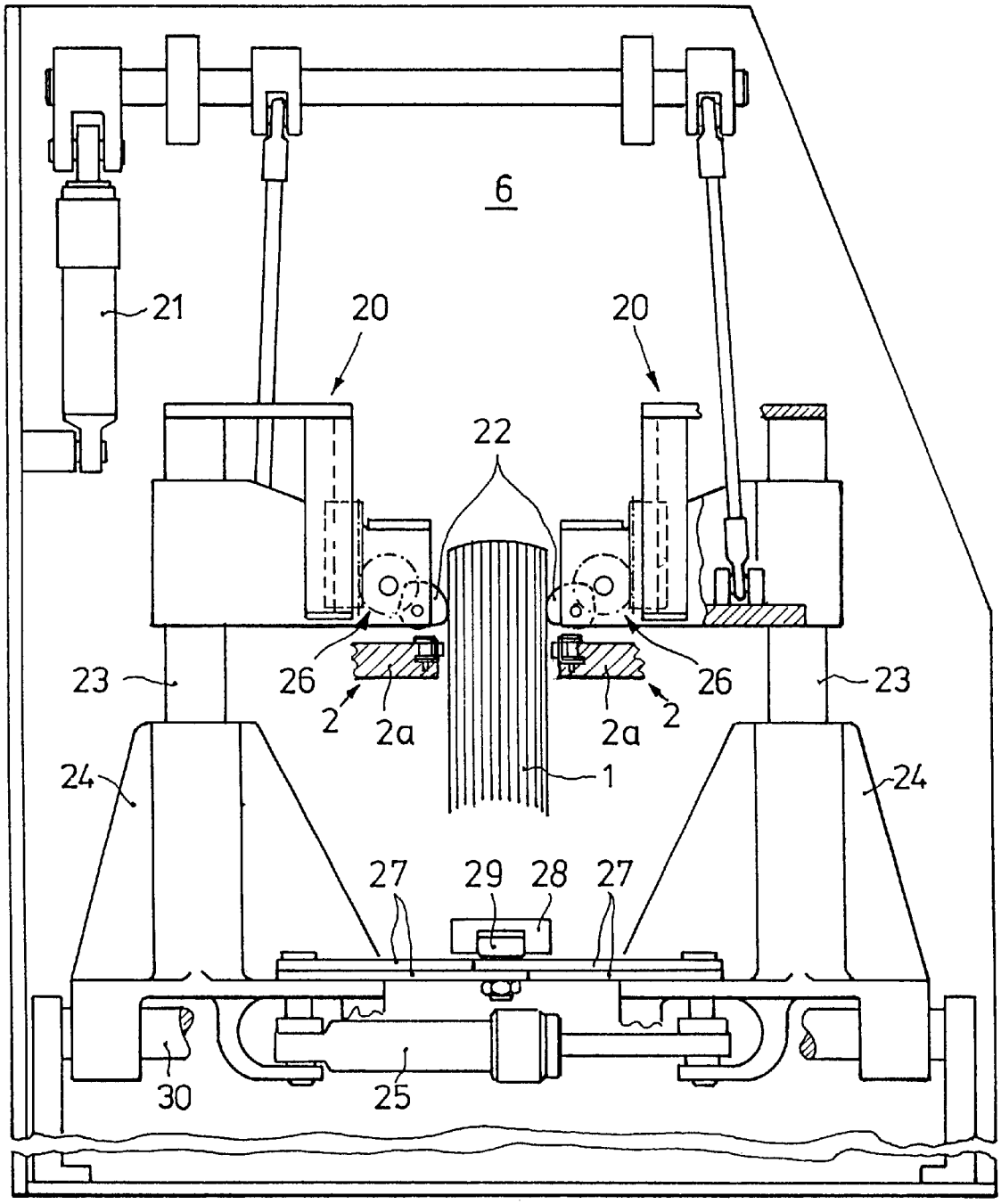
FIG. 2 is a sectional view of a rounding processing station in the individual module "B" of FIG. 1.
Figure 3:
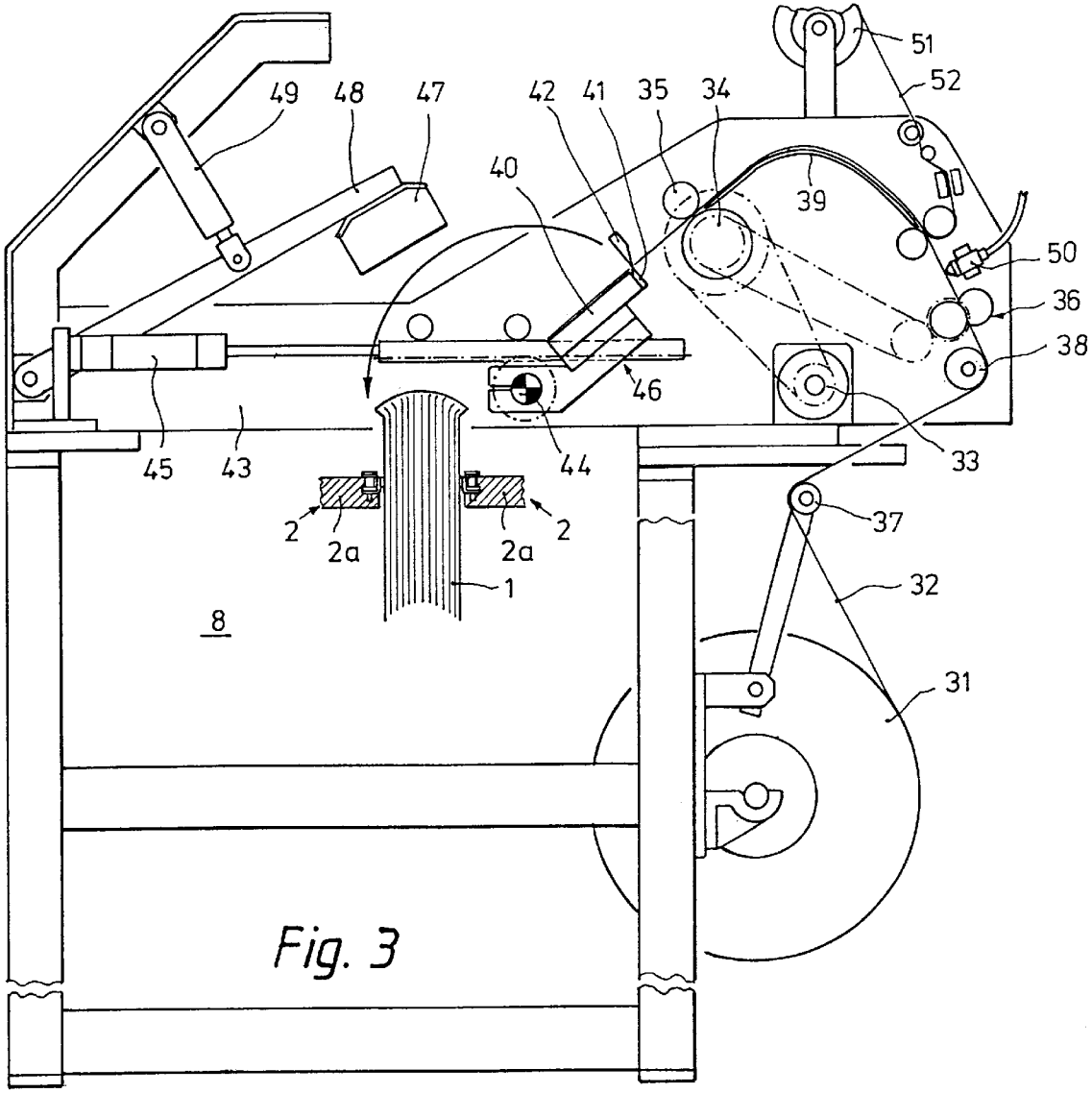
FIG. 3 is a sectional view, partly broken away of a bracing and heading processing station in the individual module "C" of FIG. 1.

Purely by way of example, the processing stations 6 and 8 in the modules B and C are described in FIGS. 2 and 3 with separate drives for the functions of rounding and backing. Referring now to FIG. 2, upon leaving the straightening and pre-shaping station A, the book blocks 1 enter the processing station 6 for rounding thereof whereby the book blocks are taken up by roller-shaped rounding segments 22. After the release of the book block 1 by the transportation device 2, the roller-shaped rounding segments 22 act upon both sides of the book block with a defined rolling movement as well as pressure.

The device for back rounding comprises two rounding heads 20, in which the rounding segments 22 are mounted. The rounding heads 20 can be synchronously driven on vertical columns 23 of carriages 24 by a hydraulic cylinder 21 via a drive means. The rotary movement of the rounding segments 22 is derived from the vertical movement along vertical columns 23 via a rack and pinion drive 26. In order to apply the pressing force to the sides of the book block 1, the carriages 24 are synchronously displaced to the center of the transportation device 2 along with columns 23 via a hydraulic cylinder 25 located on horizontal guides 30. In order to achieve synchronous movement, articulated coupling rods 27 of equal length are connected to the two carriages 24 with slide rollers 29 running in a linear guide 28 aligned with the center of the transportation device 2.

Referring now also to FIGS. 1 and 3 and with the aid of the second processing station 8 of the individual module "C" illustrated by way of example in FIG. 3 with independent drives, the function of backing and heading of the rounded and pressed book block 1 will be described. The transportation device 2 transfers the book block 1 in a timed manner from the processing stations 6 and 7 for rounding and pressing into the processing station 8*a* for applying an adhesive to the back of a book block 1. Thereafter, from processing station 8*a* into the processing station 8 for simultaneously applying a rear adhesive material 32 for stabilizing the back of the book block 1 along with a head band 52. A narrow strip of dispersion adhesive is applied to the rear adhesive material 32 via one or more nozzles 50 at both ends thereof and head bands 52 supplied by spool 51 are bonded to the rear adhesive material at both ends thereof. The rear adhesive material together with the head bands 52 are applied to the back of the book block 1 with the head bands being applied both to the tail and head of the book block. The rear adhesive material 32 is withdrawn in a length corresponding to the book block thickness from a supply roller 31. The rear adhesive material 32 passes an associated compensating roller 37 and a take-up roller 34 reaching a counter roller 35 driven in stepped fashion by a stepping motor 33. The rear adhesive material 32 is supplied via a guide roller 38 and a guide plate 39 to a pivotable table 40 and is cut to a width corresponding to the book block height by roller blades 36 coupled to the drive. Low pressure air (not shown) is provided to fix the rear adhesive material 32 with the bonded head band 52 to the table 40. Integrated in the table 40 is a counter blade 41, which is brought into cooperation with an upper blade 42 by pivoting the table 40 in order to cut the rear adhesive material 32 together with the head band to a predetermined length. In order to transfer the rear adhesive strip 32 with the head band 52 cut to size onto the back of a book block 1, the table 40, which is rotatably mounted within the machine frame 43, executes a pivoting movement about an axis of rotation 44. The pivoting movement is controlled via an operating cylinder 45 which may be acted upon by compressed air and a rack and pinion drive 46. The pressing of the rear adhesive material strip 32 with the head band 52 onto the back of the book block 1 is effected after pivoting back the table 40 via a pivot lever 48, which is mounted in the machine frame 43. The pivot lever 48 is fitted with an overlay 47 made of an elastic material and is actuated by an operating cylinder 49 also, e.g., acted upon by compressed air.

The modular nature of the book production line is attained by decentralized controls 12 of the individual modules A to F and a separate operation of the individual processing stations via operating panels 18 with a control 13. The functions of the associated module and a number of related functions can be connected to the operating panels 18. The operating panels 18 can be adapted to the respective functions by a flexible programming of the function keys. The processing functions run as event-controlled step chains predetermined by the decentralized controls 12. The most important processing functions, aggregates and adjustment axes can be directly accessed via the function keys. The book block transportation is coordinated with the processing stations via a master control 14.

During setup operation, as a result of the function "intake lock open", a book block 1 is conveyed into the book production line and is processed and transported to a defined stop point in the module which triggered the function. In the module, further processing of the book block 1 occurs when individual steps are released. The stop points are defined and a respective determined processing sequence runs according to each module. As a result of the flexible processing sequence, different variants of the step chain can be carried out.

In this manner, during the setup of the book cover supply, for example, the following book block 1 can already be supplied from the suspension module E. While components are still being replaced or fine adjustments made in the book cover supply, the functions of rounding and pressing 6 and 7, fumigation 8, backing and heading 9 can be effected in the preceding stations. As a result of the uncoupled drives, no movements are triggered in the book cover supply.

In the rounding and pressing module B, the processing of the book block 1 can be interrupted after the rounding 6 and the book block can be transported to a removal station in the event that the result of the rounding step is inadequate. The book block transportation function can be triggered from any operating panel 18, so that the further transportation of the support chain is triggered by one timed interval with the predetermined movement profile.

In the event of problematic book blocks 1, such as inadequate rounding a second pivoting movement of the shaping block during pressing 7 can be prescribed, the other stations having to wait in accordance with the prolonged processing time.

As a result of the individual drives, the inauguration of the modules can be significantly simplified. In addition, a preliminary testing of the stations during the assembly of the modules is possible. Since the steps in the individual stations can be triggered independently of one another, conversion to a different format of the book block 1 can be simultaneously effected by a plurality of operators, which clearly reduces the setup time.

While the present invention has been described in connection with what is presently considered to be the most practical and preferred embodiments, t is to be understood that the present invention is not limited to the disclosed embodiments. Rather, it is intended to cover all of the various modifications and equivalent arrangements included within the spirit and scope of the appended claims.

What is claimed is:

1. A book production line for forming books including a transportation device for receiving a book block from an intake and conveying the book block along the book production line, the book production line comprising:

a plurality of individual modules each comprising a processing station with a particular function, wherein the particular functions include straightening and preshaping of the book block, rounding and pressing of the book block, gluing and fumigating of the book block, gluing, backing and heading of the book block and suspension of the book block; and a plurality of independent operating panels for separately operating the individual modules.

2. A book production line according to claim 1, wherein said plurality of individual modules further comprise a processing station for pressing and shaping the books.

3. A book production line according to claim 1, wherein:

the processing stations each comprise independent drives each of which operate means for carrying out the particular functions;

each of said drives are separately operable; and a sequence of the various functions is predetermined and operated by step chains controlled by decentralized controls responsive to the operating panels.

4. A book production line according to claim 1, wherein the book production line is constructable and dismantleable by the direct coupling of individual modules to form a production line wherein the transportation device is continuous.

5. A book production line according to claim 3, wherein the book production line is constructable and dismantleable by the direct coupling of individual modules to form a line wherein the transportation device is continuous.

6. A book production line according to claim 1, wherein a sequence of the functions is predetermined in event controlled step chains via decentralized controls of the individual modules.

7. A book production line according to claim 3, wherein the sequence of the functions is predetermined in event controlled step chains via the decentralized controls of the individual modules.

8. A book production line according to claim 4, wherein the sequence of the functions is predetermined in event controlled step chains via the decentralized controls of the individual modules.

9. A book production line according to claim 1, further comprising:

individual drives for functions and movements in the processing stations; and a sequence control for controlling the individual drives for functions and movements in the processing stations.

10. A book production line according to claim 3, further comprising a sequence control for controlling the individual drives for functions and movements in the processing stations.

11. A book production line according to claim 4, further comprising:

individual drives for functions and movements in the processing stations; and a sequence control for controlling the individual drives for functions and movements in the processing stations.

12. A book production line according to claim 6, further comprising:

individual drives for functions and movements in the processing stations; and a sequence control for controlling the individual drives for functions and movements in the processing stations.

13. A book production line according to claim 1, wherein:

each of the book blocks has a height; and the processing stations are arranged at defined timed intervals and are aligned relative to one another with a center of the book block height by the transportation device.

14. A book production line according to claim 1, wherein:

each of the book blocks has a height; and the processing stations are arranged at defined timed intervals and are aligned relative to one another with a center of the book block height by the transportation device, the transportation device being continuous from the intake to the individual module having the function of suspension and the transportation device being driven by a drive motor in an intermittent manner for conveying the book blocks to the individual processing stations and into a position aligned with the center of the book block height.

15. A book production line according to claim 3, wherein:

each of the book blocks has a height; and the processing stations are arranged at defined timed intervals and are aligned relative to one another with a center of the book block height by the transportation device, the transportation device being continuous from the intake to the individual module having the function of suspension and the transportation device being driven by a drive motor in an intermittent manner for conveying the book blocks to the individual processing stations and into a position aligned with the center of the book block height.

16. A book production line according to claim 5, wherein:

each of the book blocks has a height; and the processing stations are arranged at defined timed intervals and are aligned relative to one another with a center of the book block height by the transportation device, the transportation device being continuous from the intake to the individual module having the function of suspension and the transportation device being driven by a drive motor in an intermittent manner for conveying the book blocks to the individual processing stations and into a position aligned with the center of the book block height.

17. A book production line according to claim 7, wherein:

each of the book blocks has a height; and the processing stations are arranged at defined timed intervals and are aligned relative to one another with a center of the book block height by the transportation device, the transportation device being continuous from the intake to the individual module having the function of suspension and the transportation device being driven by a drive motor in an intermittent manner for conveying the book blocks to the individual processing stations and into a position aligned with the center of the book block height.

18. A book production line according to claim 3, wherein the transportation device comprises a conveying means clamping the book blocks, and the individual modules have a grid size, which lies in a timed interval and corresponds to a multiple of a chain pitch.

19. A book production line according to claim 5, wherein the transportation device comprises a conveying means clamping the book blocks, and the individual modules have a grid size, which lies in a timed interval and corresponds to a multiple of a chain pitch.

20. A book production line according to claim 7, wherein the transportation device comprises a conveying means clamping the book blocks, and the individual modules have a grid size, which lies in a timed interval and corresponds to a multiple of a chain pitch.

21. A book production line according to claim 10, wherein the transportation device comprises a conveying means clamping the book blocks, and the individual modules have a grid size, which lies in a timed interval and corresponds to a multiple of a chain pitch.

22. A book production line according to claim 15, wherein the transportation device comprises a conveying means clamping the book blocks, and the individual modules have a grid size, which lies in a timed interval and corresponds to a multiple of a chain pitch.

23. A book production line according to claim 3, further comprising a master control for coordinating the independent drives for the functions and movements in the processing stations with the drive for the movement of the transportation device.

24. A book production line according to claim 5, further comprising a master control for coordinating the independent drives for the functions and movements in the processing stations with the drive for the movement of the transportation device.

25. A book production line according to claim 7, further comprising a master control for coordinating the independent drives for the functions and movements in the processing stations with the drive for the movement of the transportation device.

26. A book production line according to claim 10, further comprising a master control for coordinating the independent drives for the functions and movements in the processing stations with the drive for the movement of the transportation device.

27. A book production line according to claim 15, further comprising a master control for coordination the independent drives for the functions and movements in the processing stations with the drive for the movement of the transportation device.

28. A book production line according to claim 18, further comprising a master control for coordinating the independent drives for the functions and movements in the processing stations with the drive for the movement of the transportation device.

* * * * *